US008225777B2

(12) United States Patent
Chu

(10) Patent No.: US 8,225,777 B2
(45) Date of Patent: Jul. 24, 2012

(54) CROSSBOW

(75) Inventor: Fu-Hui Chu, Dongshi Township (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 284 days.

(21) Appl. No.: 12/773,087

(22) Filed: May 4, 2010

(65) Prior Publication Data

US 2011/0271938 A1 Nov. 10, 2011

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS 5,553,596 A * 9/1996 Bednar ..... 124/25
7,178,514 B2 * 2/2007 Chang ..... 124/25
7,584,750 B2 * 9/2009 Chang ..... 124/25

* cited by examiner

*Primary Examiner* — John Ricci
(74) *Attorney, Agent, or Firm* — Muncy, Geissler, Olds & Lowe, PLLC

(57) ABSTRACT

A crossbow has a stock assembly and a bow assembly. The stock assembly has a body, a retainer and a buffering spacer. The retainer is made of hardened plastic and has a vibrating frequency, a bolt groove, a mounting hole and a holding protrusion. The buffering spacer is made of hardened plastic and has a shape corresponding to the retainer, a vibrating frequency different from the vibrating frequency of the retainer, a gap, a through hole and a holding hole. The bow assembly is securely connected to the stock assembly and has a mounting base, two bow arms, a bowstring and a fastener. The different vibrating frequencies between the buffering spacer and the retainer can destroy the transmission of the shock wave between the retainer and the buffering spacer to disperse and reduce the impact force of the crossbow after shooting a bolt.

6 Claims, 3 Drawing Sheets

CROSSBOW

BACKGROUND OF THE INVENTION

1. Field of the Invention

The present invention relates to a crossbow, and more particularly to a crossbow that has a buffering-damping device to provide a buffering-damping effect to users.

2. Description of Related Art

A conventional crossbow has a stock assembly and a bow assembly. The stock assembly has a body and a retainer. The retainer is securely mounted around a front end of the body. The bow assembly is connected to the stock assembly and has a mounting base and multiple fasteners. The mounting base has a mounting recess to mount around the retainer. The fasteners are mounted through the mounting base and the retainer and are screwed with the front end of the body.

When the conventional crossbow is in use, the retainer of the conventional crossbow can provide a damping effect after shooting a bolt. However, the damping effect provided by the retainer of the conventional crossbow is not sufficient and the body of the stock assembly still bears a large impact force and vibrates.

The invention provides a crossbow that mitigates or obviates the aforementioned problems.

SUMMARY OF THE INVENTION

The main objective of the present invention is to provide a crossbow that can provide buffering-damping effect to users.

The crossbow in accordance with the present invention has a stock assembly and a bow assembly. The stock assembly has a body, a retainer and a buffering spacer. The retainer is made of hardened plastic and has a vibrating frequency, a bolt groove, a mounting hole and a holding protrusion. The buffering spacer is made of hardened plastic and has a shape corresponding to the retainer, a vibrating frequency different from the vibrating frequency of the retainer, a gap, a through hole and a holding hole. The bow assembly is securely connected to the stock assembly and has a mounting base, two bow arms, a bowstring and a fastener. The buffering spacer is mounted between the retainer and the mounting base. The different vibrating frequencies between the buffering spacer and the retainer prevents transmission of shock waves between the retainer and the buffering spacer to disperse and reduce the impact force of the crossbow after shooting a bolt.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
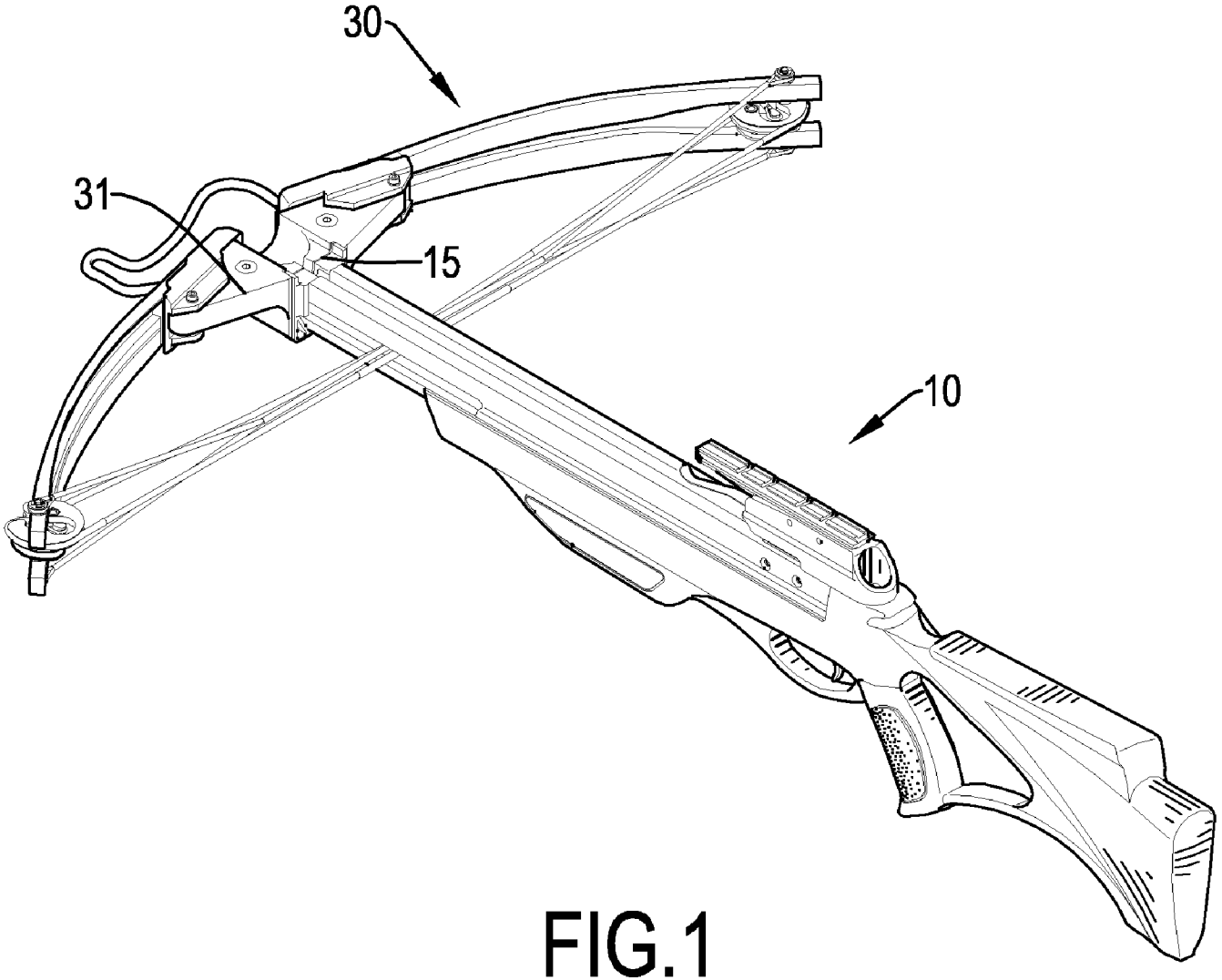
FIG. 1 is a perspective view of a crossbow in accordance with the present invention.
Figure 2:
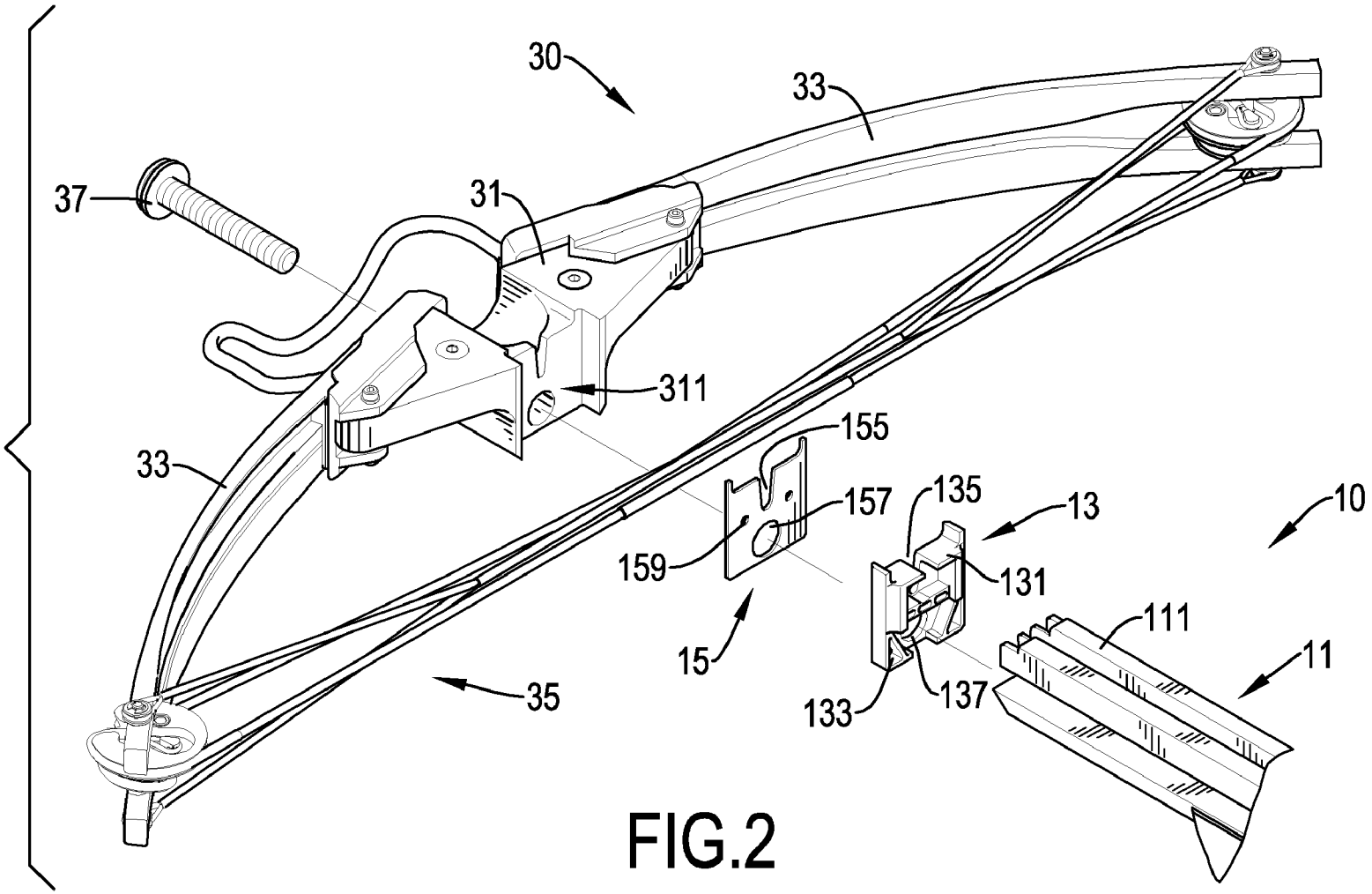
FIG. 2 is an enlarged exploded perspective view of the crossbow in FIG. 1.
Figure 3:
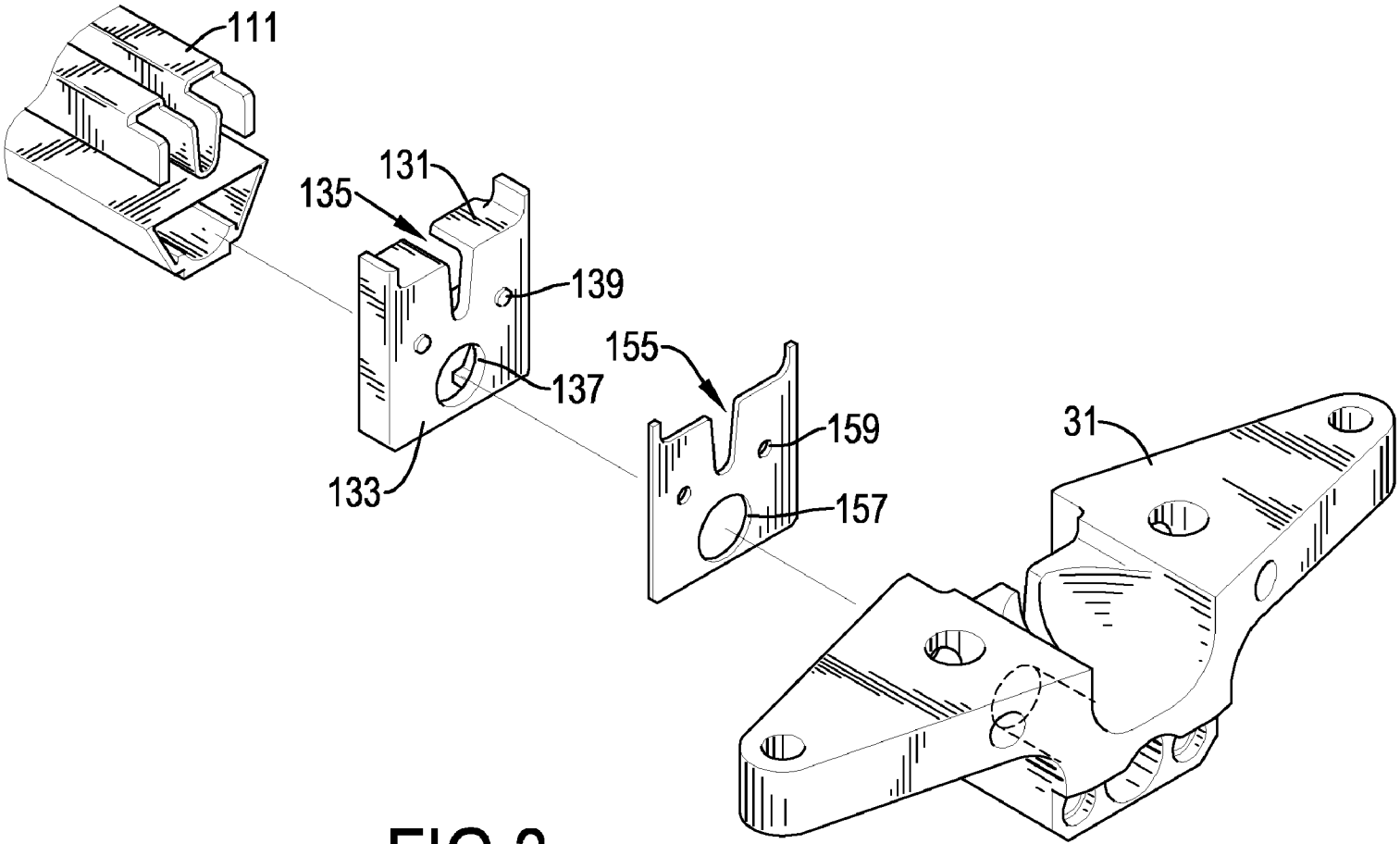
FIG. 3 is another enlarged exploded perspective view of the crossbow in FIG. 1.

With reference to FIGS. 1, 2 and 3, a crossbow in accordance with the present invention has a stock assembly (10) and a bow assembly (30).

The stock assembly (10) has a body (11), a retainer (13) and a buffering spacer (15).

The body (11) may be conventional and has a front end (111).

The retainer (13) may be square, is made of hardened plastic and is securely mounted around the front end (111) of the body (11) and has an outer side, a vibrating frequency, a top (131), a bottom (133), a bolt groove (135), a mounting hole (137) and two holding protrusions (139). The outer side is defined opposite to the free end (111) of the body (11). The bolt groove (135) is elongated and is formed through the top (131) of the retainer (13). The mounting hole (137) is formed through the retainer (13) near the bottom (133). The holding protrusions (139) may be protruding-button shaped and are formed on and protrude from the outer side of the retainer (13).

The buffering spacer (15) is made of hardened plastic, is mounted on the outer side of the retainer (13) and has a shape corresponding to the retainer (13), a vibrating frequency, an outer side, a gap (155), a through hole (157) and two holding holes (159). The vibrating frequency of the buffering spacer (15) is different from the vibrating frequency of the retainer (13). The outer side is defined opposite to the retainer (13). The gap (155) is formed through the buffering spacer (15) and corresponds to the bolt groove (135) of the retainer (13). The through hole (157) is formed through the buffering spacer (15) and aligns with the mounting hole (137) of the retainer (13). The holding holes (159) are formed through the buffering spacer (15) and are respectively mounted around the holding protrusions (139) of the retainer (13). Preferably, the buffering spacer (15) has a middle segment and the holding holes (159) are formed through the middle segment of the buffering spacer (15) and align with each other.

The bow assembly (30) is securely connected to the stock assembly (10) and has a mounting base (31), two bow arms (33), a bowstring (35) and a fastener (37). The mounting base (31) may be T-shaped, is mounted around the retainer (13) and the buffering spacer (15) and has an inner side and a mounting recess (311). The mounting recess (311) is formed in the inner side of the mounting base (31) and is mounted around the buffering spacer (15) and the retainer (13) and has a bottom. The bottom of the mounting recess (311) abuts against the outer side of the buffering spacer (15). The bow arms (33) are securely connected to the mounting base (31) and each bow arm (33) has a free end opposite to the mounting base (31). The bowstring (35) is connected to the free ends of the bow arms (33). The fastener (37) is mounted through the mounting base (31), the through hole (157) of the buffering spacer (15) and the mounting hole (137) of the retainer (13) and is screwed with the free end (111) of the body (11) to hold the retainer (13) and the buffering spacer (15) between the mounting base (31) and the body (11).

When using the crossbow in accordance with the present invention to shoot a bolt, the buffering spacer (15) is mounted between the retainer (13) and the mounting base (31) of the bow assembly (30). The different vibrating frequencies between the buffering spacer (15) and the retainer (13) prevents transmission of shock waves between the retainer (13) and the buffering spacer (15) to disperse and reduce the impact force of the crossbow after shooting a bolt.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A crossbow having a stock assembly having a body having a front end;

a retainer being made of hardened plastic, securely mounted around the front end of the body and having a vibrating frequency;

a top;

a bottom;

a bolt groove being elongated and formed through the top of the retainer;

a mounting hole formed through the retainer near the bottom; and a holding protrusion formed on and protruding from the retainer opposite to the body; and a buffering spacer being made of hardened plastic, mounted on the retainer and having a shape corresponding to the retainer;

a vibrating frequency being different from the vibrating frequency of the retainer;

a gap formed through the buffering spacer and corresponding to the bolt groove of the retainer;

a through hole formed through the buffering spacer and aligning with the mounting hole of the retainer; and a holding hole formed through the buffering spacer and mounted around the holding protrusion of the retainer; and a bow assembly securely connected to the stock assembly and having a mounting base mounted around the retainer and the buffering spacer and having a mounting recess formed in the mounting base and having a bottom abutting against the buffering spacer opposite to the retainer;

two bow arms securely connected to the mounting base and each bow arm having a free end opposite to the mounting base;

a bowstring connected to the free ends of the bow arms; and a fastener mounted through the mounting base, the through hole of the buffering spacer and the mounting hole of the retainer and screwed with the free end of the body to hold the retainer and the buffering spacer between the mounting base and the body.

2. The crossbow as claimed in claim 1, wherein the retainer has another holding protrusion formed on and protruding from the retainer; and the buffering spacer has another holding hole formed through the buffering spacer and mounted around the another holding protrusion of the retainer.

3. The crossbow as claimed in claim 2, wherein the buffering spacer has a middle segment; and the holding holes are formed through the middle segment of the buffering spacer and aligning with each other.

4. The crossbow as claimed in claim 3, wherein the holding protrusions of the retainer are protruding-button shaped.

5. The crossbow as claimed in claim 2, wherein the holding protrusions of the retainer are protruding-button shaped.

6. The crossbow as claimed in claim 1, wherein the holding protrusion of the retainer is protruding-button shaped.

* * * * *